US005214802A

United States Patent [19]

McCallum

[11] Patent Number: 5,214,802

[45] Date of Patent: Jun. 1, 1993

[54] CONVERTIBLE HAT AND BAG ASSEMBLY

[76] Inventor: Timothy P. McCallum, 625 B Bonair Pl., La Jolla, Calif. 92037

[21] Appl. No.: 774,800

[22] Filed: Oct. 10, 1991

[51] Int. Cl.[5] ..... A42B 1/04

[52] U.S. Cl. ..... 2/196; 2/195

[58] Field of Search ..... 2/185 R, 195, 196, 199, 2/209.1, 10, 12; 190/1; 383/4, 109, 113, 115

[56] References Cited

U.S. PATENT DOCUMENTS

| | | | |
|---|---|---|---|
| 1,172,927 | 2/1916 | Bloch | 2/196 |
| 2,597,447 | 5/1952 | Bruns | 2/185 R |
| 2,708,273 | 5/1955 | Bonaventura | 2/196 |
| 3,285,307 | 11/1966 | Dormaier | 2/196 |
| 4,165,542 | 8/1979 | McLaughlin | 2/209.1 |
| 4,317,238 | 3/1982 | Amin | 2/12 |
| 4,610,038 | 9/1986 | Dennard | 2/209.1 |
| 4,630,317 | 12/1986 | Brown | 2/199 |
| 5,070,545 | 12/1991 | Tapia | 2/195 |

*Primary Examiner*—Clifford D. Crowder

*Assistant Examiner*—Diana L. Biefeld

*Attorney, Agent, or Firm*—Brown, Martin, Haller & McClain

[57] ABSTRACT

A convertible hat and bag assembly is formed from a first, hat-shaped layer and a separate, bag-shaped enclosure secured around part of its area to the peripheral edge of the hat-shaped layer to form a double layer over at least part of the area of the enclosure. The bag-shaped enclosure can be stowed inside the hat-shaped layer in order to use the assembly as a hat, while the assembly can be turned inside out with the bag-shaped enclosure outermost and the hat-shaped layer stowed inside the enclosure in order to use the assembly as a bag. The bag enclosure may be in the form of a small bag layer secured around its periphery to the periphery of the hat layer, and may have straps for wearing around the waist. In another version, the bag is a tubular member with closed ends and the hat layer is sewn inside the bag across one of the closed ends.

11 Claims, 3 Drawing Sheets

CONVERTIBLE HAT AND BAG ASSEMBLY

BACKGROUND OF THE INVENTION

The present invention relates generally to a convertible hat and bag assembly which can function alternatively as a head covering or as a bag.

In U.S. Pat. No. 4,610,038 of Dennard, a hat/tote bag combination article is described which comprises a tubular member having a body portion and two closed ends which function as a tote bag in one configuration. The body portion and one closed end of the bag are folded and nested into the second closed end of the bag in an alternative configuration in which the second closed end of the bag functions as a hat. One problem with this arrangement is that different hat and bag styles and fabrics cannot easily be accommodated where the body of the hat must be able to function as the closed end of a tubular bag when turned inside out, and similarly, part of the bag must be able to function as a hat.

SUMMARY OF THE INVENTION

It is an object of this invention to provide a new and improved combination hat and bag assembly.

According to the present invention, a combination hat and bag assembly is provided which comprises a hat-shaped layer and a separate, bag-shaped enclosure secured around part of its area to the peripheral edge of the hat-shaped layer to form a double layer over at least part of the area of the assembly. The bag-shaped enclosure can be stowed inside the hat shaped layer with the hat layer outermost when the assembly is worn as a hat, while the assembly can be inverted with the bag-shaped enclosure outermost and the hat layer stowed within the enclosure when the assembly is used as a bag.

In one embodiment of the invention, the bag enclosure comprises a layer secured around its peripheral edge to the peripheral edge of the hat layer to form a double layer assembly, and the assembly is simply reversed to convert between hat and bag. Preferably, this assembly is designed to be worn as a hip bag, and one or more straps are provided for extending around a wearer's waist and securing the bag in place. The straps are stowed inside the hat layer when the assembly is to be worn as a hat. The bag layer may have pockets for stowing of smaller items and an access opening for access to the space between the layers for stowing items between the layers. A hat brim may be provided at the peripheral edge of the assembly, which can function as a closure flap for the bag when the assembly is used in its bag configuration.

In another embodiment of the invention, the bag enclosure is a tubular member having an inner surface and an outer surface with an access opening for access to the interior of the enclosure, and suitable carrying straps or the like attached on the outer surface. The hat layer is secured to the inner surface of the tubular member adjacent one end, so that it will be stowed inside the bag when not in use. When the assembly is to be used as a hat, the tubular member is turned inside out via the access opening, and then stowed inside the hat layer so that the assembly can be worn as a hat.

Since the hat layer and bag or enclosure are separate parts which are secured together around the periphery of the hat layer, they may be of different materials, fabric patterns, or colors, and the hat layer may be shaped in any desired hat style, such as beanie, baseball cap with a small brim, rain hat with a continuous brim, and so on, without requiring any change in the overall shape of the bag itself. Similarly, the shape of the bag is not constricted in any way by the shape of the hat.

BRIEF DESCRIPTION OF THE DRAWINGS

The present invention will be better understood from the following detailed description of some preferred embodiments of the invention, taken in conjunction with the accompanying drawings, in which like reference numerals refer to like parts, and in which.

DESCRIPTION OF THE PREFERRED EMBODIMENTS

Figure 2:
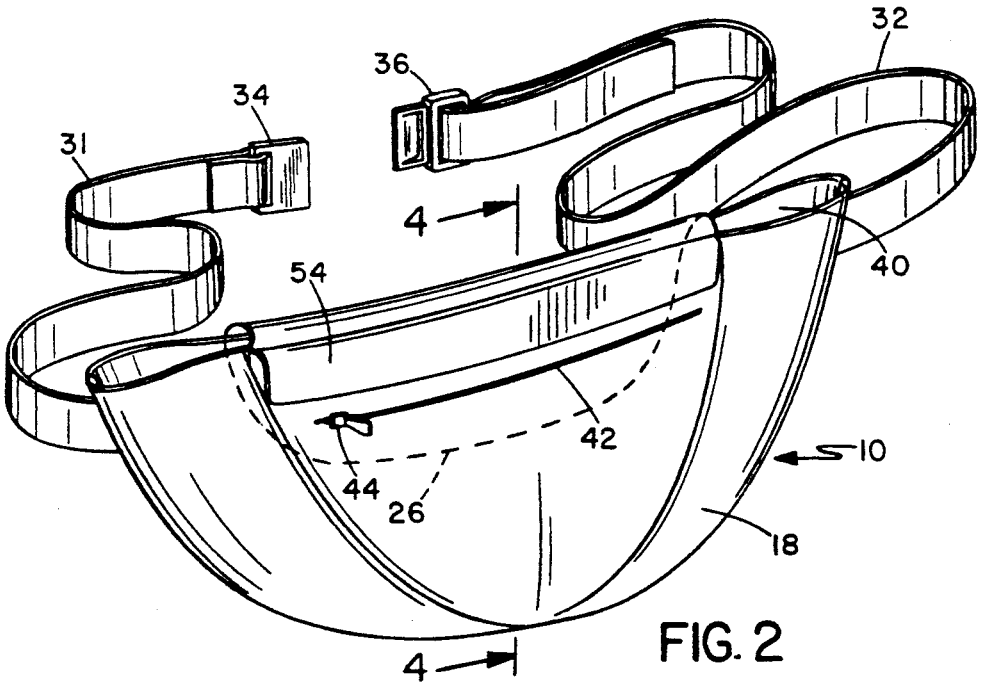
FIG. 2 is a perspective view of the device folded into a hip bag configuration.
Figure 3:
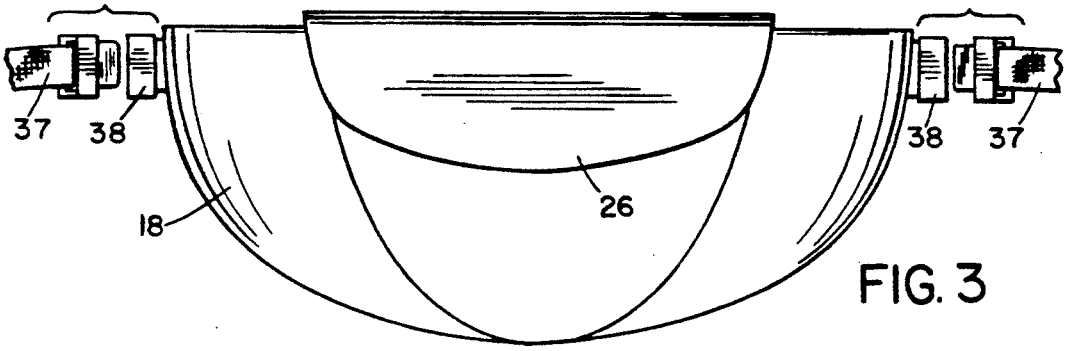
FIG. 3 is a rear elevational view of the device folded as in FIG. 2, illustrating a modified strap arrangement.
Figure 4:
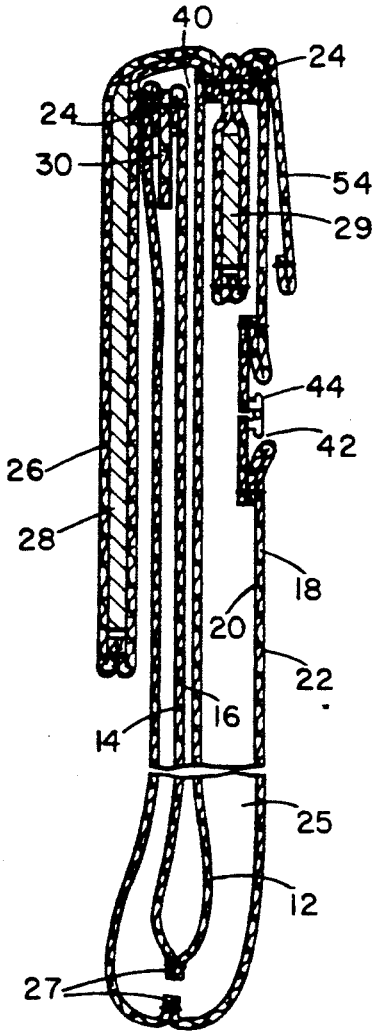
FIG. 4 is an enlarged sectional view taken on line 4—4 of FIG. 2.

FIGS. 1 to 5 of the drawings illustrate a first embodiment of a convertible hat and bag assembly 10 which comprises a combination hat and hip or waist carried bag. The assembly is illustrated in a first configuration as a hat in FIG. 1, and reversed to form a hip bag in FIG. 2. The assembly basically comprises a first, hat-shaped layer 12 having an inner side 14 and an outer side 16, and a second, bag forming layer or enclosure 18 having an inner side 20 and an outer side 22. The two layers are secured together around their matching peripheral edges via stitching 24 or the like, with their inner sides facing inwardly to form a double layered structure with a gap or pocket 25 between the layers, as best illustrated in FIG. 4.

Each layer may be formed from several stitched together panels designed to produce the desired hat and bag shapes, with the panel edges 27 facing inwardly as illustrated in FIG. 4 so that they are always concealed.

Figure 1:
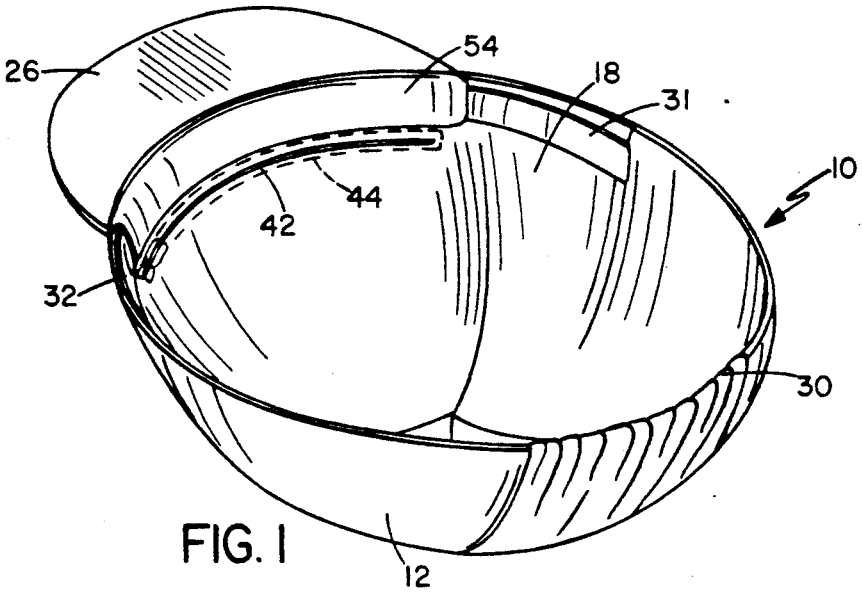
FIG. 1 is a perspective view of the device according to a first embodiment of the invention in a cap configuration.

The assembly may be used as a hat when the hat layer 12 is outermost, as in FIG. 1, and the bag layer then forms an inner lining to the hat. The hat layer may be of any style. In the illustrated embodiment, the layer 12 is designed in a baseball cap like style, with a projecting brim 26 sewn in along a forward edge of the cap. The brim may be suitably reinforced so that it will stand out, for example via an internal stiffening layer 28 of foam, card, or the like, as illustrated in FIG. 4.

A reinforcing or interfacing strip 29 may be sewn in around the periphery of the device between the overlying edges of the two layers, with a separate strip 30 of elasticized material being sewn in between the superimposed edges of the two layers at the rear of the hat layer, to allow a closer fit for different head sizes when the assembly is worn as a hat. Alternatively, the elasticized back may be replaced by an adjustable fastener such as plastic or leather straps with snap or Velcro® fasteners, as on some baseball caps, for size adjustment.

In alternative embodiments, hat layer 12 may be made in other shapes and styles, for example with a continuous brim around its entire periphery, or no brim, and with a flat top and cylindrical sides rather than a rounded, beanie-like shape as in the illustrated embodiment. Instead of a permanent brim, a removable brim may be used. The brim may be in the form of a plastic visor which has arms inserted through slits on opposite sides of the bag layer 18, allowing the visor to be used alone or in conjunction with the hat.

In order to convert the assembly into a bag, the hat as illustrated in FIG. 1 is turned inside out so that the bag layer 18 is outermost and the hat layer is stowed inside the bag, forming an inner lining to the bag. A pair of waist straps 31, 32 are sewn to opposite sides of the bag layer, with suitable interengageable fasteners such as the female and male interengageable snap fasteners 34, 36 provided at the free ends of the straps for securing the bag around a person's waist. FIG. 3 illustrates a modified strap arrangement. In this alternative, instead of having a pair of straps permanently attached to the bag, a single adjustable strap 37 is releasably secured at each end to the bag via suitable releasable fasteners 38 on each side of the bag. As in FIG. 3, releasable male and female snap fasteners may be used, or alternative fasteners such as Velcro® or buckles may be used to secure the strap ends to the bag.

Figure 5:
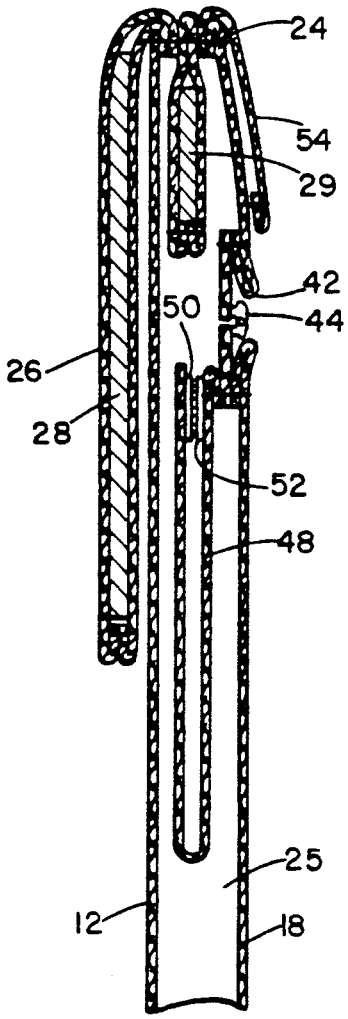
FIG. 5 is a similar sectional view showing a dual pocket arrangement.

When the assembly is used as a bag, the assembly is flattened and the hat brim 26 may be folded down over the bag opening 40, as illustrated in FIGS. 2 and 3, with the bag being worn with the brim facing inwardly towards the wearer's body so that it is trapped to securely close the bag. Additionally, the bag layer is provided with an opening slit 42 which may be closed by a zipper fastener 44 or other types of fasteners such as snaps or Velcro®, allowing articles to be stowed in the space or pocket 25 formed between the bag and hat layers. FIG. 5 illustrates a modification in which a separate, smaller pocket 48 is sewn into the inner surface of the bag layer at opening 42. Pocket 48 has an access opening 50 closed by a suitable releasable fastener 52 such as snaps or Velcro®. The smaller pocket 48 can be used to store small items such as keys or money when the assembly is used as a bag or hat. It can also be used for storage of removable strap 37 in the version of FIG. 3. In the latter case, the flap 54 would be omitted. The modified embodiment in FIG. 5 is otherwise identical to the embodiment in FIGS. 1 to 4, and like reference numerals have been used for like parts.

Where the straps are permanently secured to the bag, as in FIG. 2, a strip-like flap or pocket 54 may be provided on the bag layer for stowing the straps when the assembly is in use as a hat, so that they do not cause discomfort to the wearer. Alternatively, as illustrated in FIG. 3, the strap or straps may simply be removable via suitable snap fasteners, Velcro® or center push buckles 38 securing the strap to a mating strap end secured to the bag. The strap 37 can be detached and stored between the two layers or in small pocket 48 while the assembly is used as a hat.

With this arrangement, there is no need for an individual who is out walking, jogging, or cycling to carry a separate hat and bag. Instead, a single, compact hat and bag assembly may be used, with small items such as money and keys stored in the small pocket 48 or in space 25 between the double, hat and bag layers. If it is hot and sunny, the assembly is worn as a hat with the straps either stowed behind flap 54, or, if a single detachable strap is used, with the detachable strap stored in the pocket. If a hat is not needed, the assembly is reversed and worn conveniently around the waist.

Figure 6:
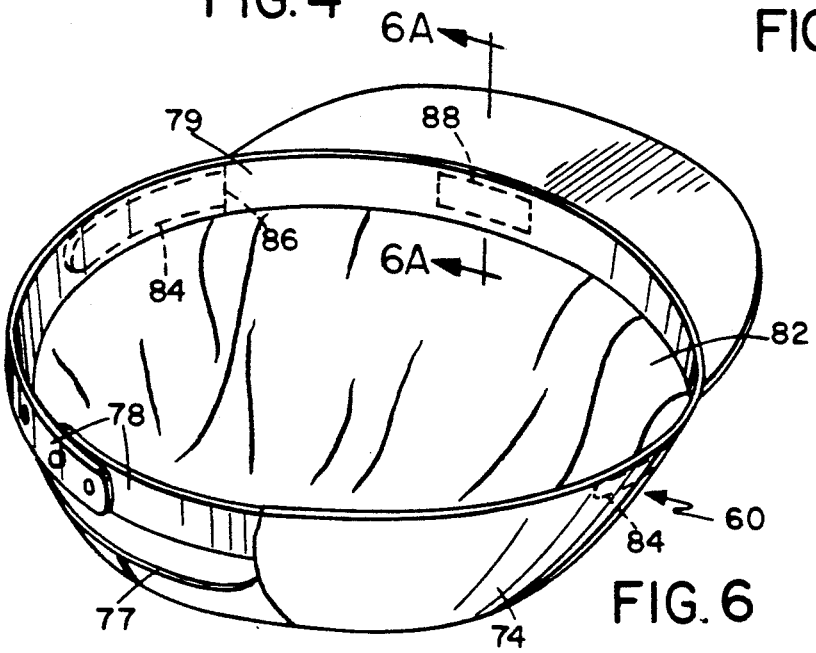
FIG. 6 is a perspective view of a combined hat and bag assembly according to a second embodiment of the invention, with the assembly configured to form a cap containing a folded carry bag.
Figure 7:
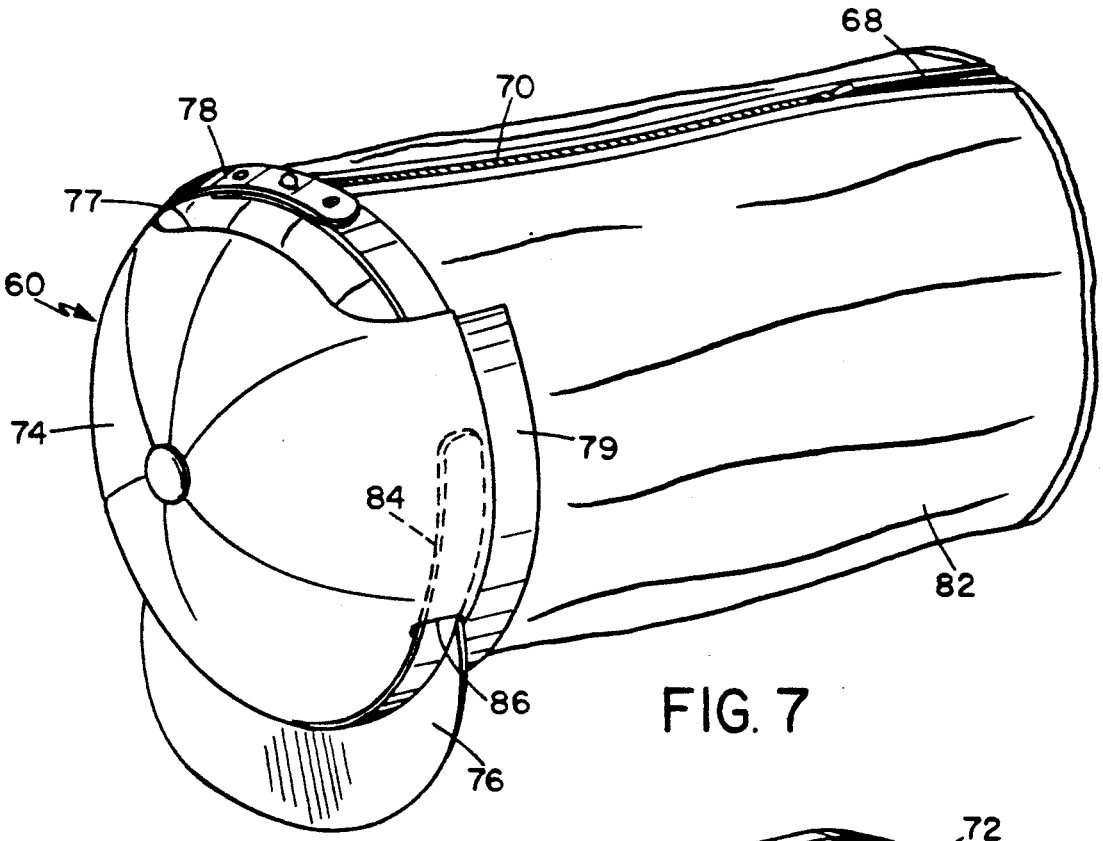
FIG. 7 illustrates the carry bag pulled out from inside the cap.
Figure 8:
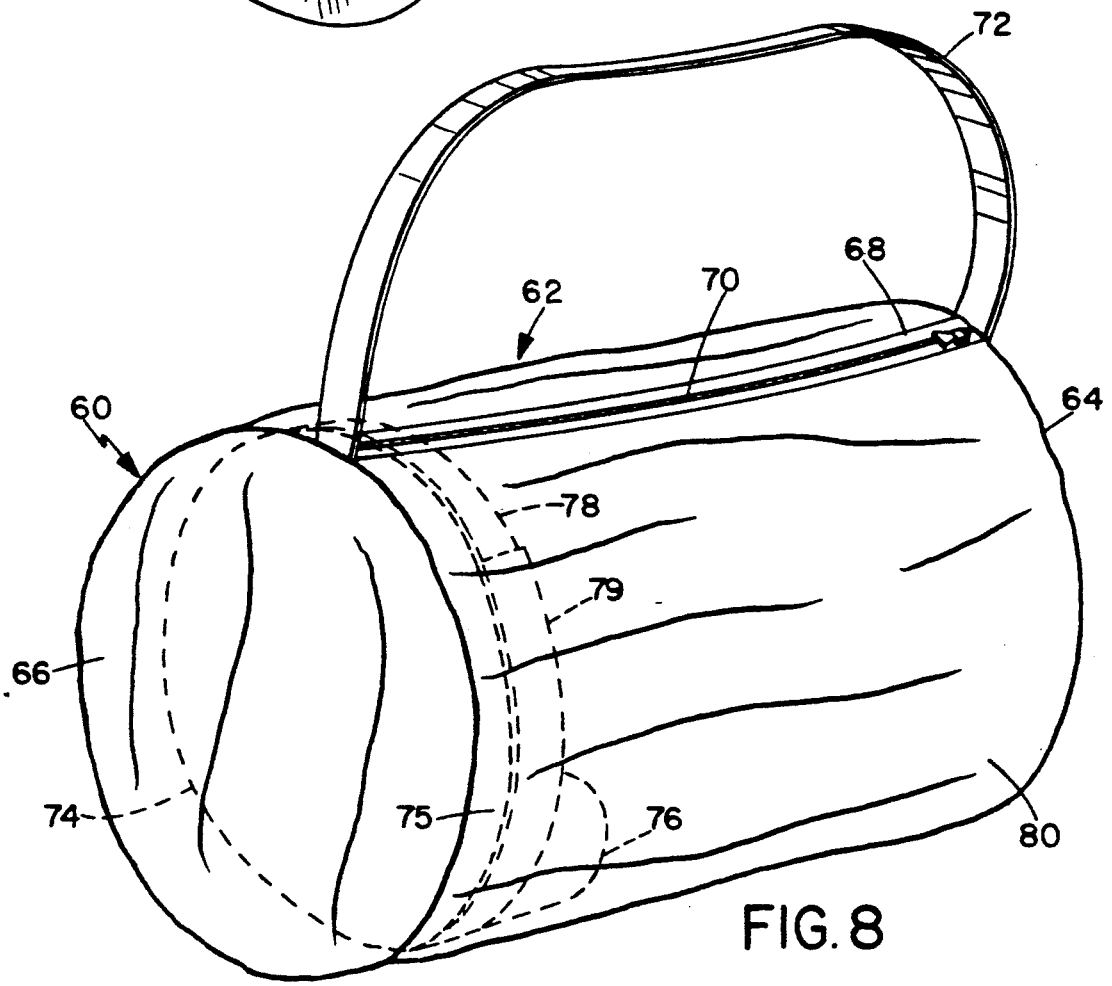
FIG. 8 illustrates the carry bag turned inside out with the cap concealed inside.

FIGS. 6 to 8 illustrate an alternative embodiment comprising a combination hat and tote bag assembly 60. In this arrangement, a tubular tote bag 62 has opposite first and second ends 64, 66 and an opening 68 for access to the interior of the bag, with a suitable zipper 70 or other fastener for closing the bag, and any suitable carrying strap or straps such as the single strap 72 as illustrated in FIG. 7. A separate hat layer 74 is sewn around its periphery via stitching 75 to the periphery of the bag at one end 66, but with a gap in the stitching at the rear of the hat.

The hat may be of any desired style, as in the previous embodiment, such as a baseball cap style with a removable plastic or other rigid visor 76 as illustrated in the drawings, or any other styles including flat top, continuous brim, or brimless styles. Thus, the hat layer forms a double layer at one end of the bag, as best illustrated in FIG. 7. The hat layer may be provided with an elasticized portion at the rear of its peripheral edge for better fitting, as in the previous embodiment. However, in the illustrated embodiment, the hat layer is provided with a cut-away opening 77 at the back. A pair of straps 78 extend from opposite sides of the opening 77, as illustrated in FIG. 6. The straps have adjustable fasteners, for example snap fasteners or Velcro®, at their ends to adjust the hat size. A reinforcing flap 79 is provided around at least part of the periphery of the hat.

In FIG. 8, the assembly is illustrated ready for use as a bag, with the outer surface 80 of the bag facing outward and the hat layer 74 contained within the bag. When the user wishes to convert the bag into a hat, they simply open zipper 70, turn the bag inside out so that the inner surface 82 is outermost, as in FIG. 7, and then fold and stow the bag 62 inside the hat layer, as illustrated in FIG. 6, so that the assembly can be worn on the head. The procedure is reversed when the hat is converted back into a bag.

Figure 6A:
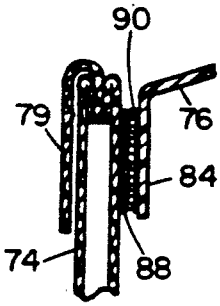
FIG. 6A is a section on the lines 6A—6A of FIG. 6.

The removable plastic visor 76 has arms 84 which extend through slits 86 on opposite sides of hat layer 74. Mating Velcro® strips 88, 90 on the inner surface of the visor and the front of the hat secure the visor in place, as best illustrated in FIG. 6A. This allows the visor to be worn separably from the rest of the assembly when it is in use as a bag, and attached to the hat when the bag is not needed. The visor may be stored inside the bag when not in use.

Since the hat is formed as a completely separate layer from the bag, it may be of a completely different material type and appearance, and its shape is not limited by the contours of the bag. Similarly, the shape of the bag is not constrained in any way by the contours of the separate hat layer.

Although some preferred embodiments of the invention have been described above by way of example only, it will be understood by those skilled in the field that modifications may be made to the disclosed embodiments without departing from the scope of the invention, which is defined by the appended claims.

I claim:

1. A convertible hat and bag assembly, comprising:

a first, hat layer shaped for forming a hat for placing on the head of a wearer, the first layer having a peripheral edge defining the periphery of the hat, an inner surface, and an outer surface;

a second, single bag-forming layer separate from said hat layer and shaped to form a complete bag-shaped enclosure having an access opening, the second layer having an inner surface and an outer surface and being secured to the hat layer only along at least part of the peripheral edge of the hat layer to form a double walled region extending over the entire hat layer and at least part of the surface of the bag-forming layer, the inner surfaces of said layers facing one another to define an internal space between the layers over said double-walled region;

the bag-forming layer being storable within said hat layer when the assembly is used as a hat; and the hat layer being storable within the bag forming layer when the assembly is used as a bag.

2. The assembly as claimed in claim 1, wherein the peripheral edge of the second layer is secured to the peripheral edge of said hat layer so that the double walled region extends over the entire assembly when used as a hat or as a bag.

3. The assembly as claimed in claim 2, including waist straps secured to said second layer for extending around a wearer's waist to secure the bag at the waist.

4. The assembly as claimed in claim 3, wherein the hat layer has a brim projecting from at least part of the peripheral edge of the hat layer, the brim comprising closure means for folding over the access opening of the bag to form a closure flap when the assembly is used as a bag.

5. The assembly as claimed in claim 2, wherein the second layer has an opening for access to the internal space between the two layers, and releasable fastener means for releasably closing the opening.

6. The assembly as claimed in claim 2, wherein the second layer has an opening, and a pocket member secured to the opening on the inner surface of said second layer in the internal space between the layers for forming a small pocket for carrying items.

7. The assembly as claimed in claim 1, wherein the second layer comprises a tubular member having opposite closed ends, an outer surface, and an inner surface, and an access opening for access to the interior of the tubular member, and the hat shaped layer is secured on the interior of the tubular member to extend across one of the closed ends of the bag to form a double layer at that end of the bag only, the assembly being convertible from a bag to a hat by turning the tubular member inside out through the access opening and stowing the tubular member within the hat shaped layer.

8. The assembly as claimed in claim 1, wherein the hat shaped layer is partially elasticized around part of its peripheral edge corresponding to the back of the assembly when worn as a hat.

9. The assembly as claimed in claim 1, wherein the bag layer is secured to the hat layer around part of the peripheral edge of the hat layer to leave an unsecured portion of the peripheral edge at the rear of the hat, the hat layer having a cut out at said unsecured portion, the hat having a pair of adjustable straps extending from opposite sides of said cut out, the straps having adjustable, mating fastener means at their free ends for adjustably securing the straps together to adjust the peripheral dimensions of the hat.

10. The assembly as claimed in claim 1, including a removable visor having a brim and a pair of arms projecting from the brim for engagement over a wearer's ears for supporting said brim above a wearer's face, the hat layer having a pair of slits on opposite sides for selectively receiving the arms and the visor and front of the hat having interengageable releasable fastener means for releasably securing the visor to the hat with the arms engaging in the slits and the brim projecting forwardly from the front of the hat.

11. A convertible hat and hip bag assembly, comprising:

a first, hat layer shaped for forming a hat for placing on the head of a wearer and having a first peripheral edge defining a head-receiving opening;

a second, hip bag layer separate from the hat layer and being shaped for forming a hip bag for carrying at a wearer's hip, the bag layer having a second peripheral edge substantially matching the entire peripheral edge of the hat layer and forming an access opening for access to the interior of the bag;

waist straps secured to the bag layer for extending around a wearer's waist to secure the bag at the waist;

the hat layer being secured around at least a majority of the first peripheral edge to the matching second peripheral edge of the bag layer to form a double walled structure;

the hat layer being worn outermost with the bag layer within the hat layer when the assembly is worn as a hat; and the bag layer being worn outermost with the hat layer within the bag layer when the assembly is worn as a hip bag.

* * * * *